US011267035B2

(12) United States Patent
Li

(10) Patent No.: US 11,267,035 B2
(45) Date of Patent: Mar. 8, 2022

(54) INTEGRATED FLATTENING, CUTTING, AND COLLECTING ASSEMBLY CAPABLE OF INTEGRITY MAINTENANCE

(71) Applicant: DONGGUAN UNIVERSITY OF TECHNOLOGY, Dongguan (CN)

(72) Inventor: Chuan Li, Dongguan (CN)

(73) Assignee: DONGGUAN UNIVERSITY OF TECHNOLOGY, Dongguan (CN)

( * ) Notice: Subject to any disclaimer, the term of this patent is extended or adjusted under 35 U.S.C. 154(b) by 295 days.

(21) Appl. No.: 16/417,640

(22) Filed: May 21, 2019

(65) Prior Publication Data

US 2019/0388950 A1 Dec. 26, 2019

(51) Int. Cl.

| | |
|---|---|
| ***B21D 28/26*** | (2006.01) |
| ***B21D 1/06*** | (2006.01) |
| ***B21D 43/28*** | (2006.01) |

(52) U.S. Cl.

CPC ..... *B21D 28/26* (2013.01); *B21D 1/06* (2013.01); *B21D 43/287* (2013.01)

(58) Field of Classification Search

CPC ..... B21D 28/24; B21D 28/26; B21D 28/265; B21D 1/00; B21D 1/06; B21D 43/28; B21D 43/287; B21D 45/00; B21D 45/02; B21D 45/04

See application file for complete search history.

(56) References Cited

U.S. PATENT DOCUMENTS

| | | | | |
|---|---|---|---|---|
| 3,394,432 | A * | 7/1968 | Olivier | B22F 5/085 425/78 |
| 3,440,909 | A * | 4/1969 | Alois | B21D 55/00 83/61 |
| 3,570,343 | A * | 3/1971 | Wolnosky | B21D 28/16 83/124 |
| 3,623,209 | A * | 11/1971 | Zühlke et al. | B26F 3/06 29/413 |
| 3,843,287 | A * | 10/1974 | Fowler | B22F 5/085 425/78 |
| 4,064,776 | A * | 12/1977 | Walitalo | B29C 65/7412 83/171 |
| 4,075,359 | A * | 2/1978 | Thulin | A21C 11/10 425/291 |
| 4,258,562 | A * | 3/1981 | Miller | B21C 23/14 72/267 |

(Continued)

*Primary Examiner* — Kenneth E Peterson
*Assistant Examiner* — Richard D Crosby, Jr.

(57) ABSTRACT

An integrated flattening, cutting, and collecting assembly includes a frame, a conveyor seat, and a processing rack. The processing rack is provided with a flattening cylinder and cutting cylinders, a flattening block cooperating with a steel sheet being conveyed by the conveyor seat, a cutting lift seat disposed beneath the cutting cylinders, the cutting lift seat being provided with a cutter and cutting pressing blocks, and wherein the distance between the two cutting pressing blocks is smaller than the length of the flattening block. In addition, the lower end of the cutter is disposed beneath the lower ends of the cutting pressing blocks, and this distance is the same as the thickness of the steel sheet being conveyed. The cutting pressing blocks can press and hold the steel sheet during cutting, while not affecting the cutting of the cutter, whereby the accuracy of the steel sheet cutting is greatly improved.

5 Claims, 5 Drawing Sheets

(56) References Cited

U.S. PATENT DOCUMENTS 4,774,865 A * 10/1988 Wallis ..... B21D 28/16 267/119
4,823,660 A * 4/1989 Forthmann ..... B26D 7/10 83/123
4,951,537 A * 8/1990 Bennett ..... B21D 45/006 267/119
5,195,413 A * 3/1993 Johnson ..... B23D 15/06 83/132
5,366,363 A * 11/1994 Good ..... B22F 5/08 425/352
6,056,531 A * 5/2000 Furuya ..... B29C 51/08 264/154
6,370,931 B2 * 4/2002 Bennett ..... B21D 28/16 29/893.33
6,422,283 B1 * 7/2002 Okushita ..... B29C 69/006 156/521
6,729,172 B2 * 5/2004 Aizaki ..... B21D 28/16 29/893.34
7,047,858 B2 * 5/2006 Rohrer ..... B26D 3/085 83/582
7,171,882 B2 * 2/2007 Shteyngarts ..... B26D 7/10 264/138
9,592,619 B2 * 3/2017 Rohrer ..... B26F 1/40
9,676,021 B2 * 6/2017 Lozano Bonet ..... B21D 28/16
9,919,353 B2 * 3/2018 Ziesel ..... B21D 45/003
9,993,984 B2 * 6/2018 Nagai ..... B29D 30/46
10,252,318 B2 * 4/2019 Izumi ..... H02K 15/02
2002/0104413 A1 * 8/2002 Adachi ..... B29C 67/0044 83/16
2002/0174947 A1 * 11/2002 Davis ..... H01L 21/67132 156/321
2004/0112188 A1 * 6/2004 Oishi ..... B21D 28/26 83/13
2005/0000332 A1 * 1/2005 Ennis ..... B26F 1/40 83/13
2005/0274252 A1 * 12/2005 Wakabayashi ..... B26D 1/08 83/697
2006/0107721 A1 * 5/2006 Oishi ..... B21D 28/26 72/327
2007/0113612 A1 * 5/2007 Takekoshi ..... B21D 28/26 72/335
2009/0090157 A1 * 4/2009 Schlatter ..... B21D 28/26 72/336
2009/0211327 A1 * 8/2009 Kanie ..... B21D 28/26 72/335
2009/0217793 A1 * 9/2009 Spillner ..... B26F 3/004 83/289
2009/0229336 A1 * 9/2009 Kuo ..... B21D 28/26 72/353.2
2011/0067538 A1 * 3/2011 Greenleaf ..... B21D 28/26 83/143
2011/0239834 A1 * 10/2011 Kanie ..... B21D 28/34 83/14
2014/0017443 A1 * 1/2014 Matsuda ..... B21D 22/022 428/131
2014/0033883 A1 * 2/2014 Yuhara ..... B29C 66/433 83/23
2016/0052039 A1 * 2/2016 Marti ..... B21D 28/26 72/332
2018/0200773 A1 * 7/2018 Nishijima ..... B21D 53/28
2018/0297100 A1 * 10/2018 Murata ..... B21D 28/24
2019/0039112 A1 * 2/2019 Hirata ..... H01M 8/0206
2019/0247906 A1 * 8/2019 Serizawa ..... B21D 22/20
2019/0388950 A1 * 12/2019 Li ..... B21D 1/00
2019/0389021 A1 * 12/2019 Li ..... B23Q 17/22
2019/0389022 A1 * 12/2019 Li ..... G01N 21/89
2019/0389024 A1 * 12/2019 Li ..... B23Q 17/22
2020/0269303 A1 * 8/2020 Takahashi ..... B21D 28/02
2020/0290106 A1 * 9/2020 Sumiyama ..... B21D 45/003
2020/0331052 A1 * 10/2020 Lozano Bonet ..... G05B 19/042
2020/0391326 A1 * 12/2020 Zhou ..... B21D 28/10
2020/0406334 A1 * 12/2020 Charles ..... B21D 28/02

* cited by examiner

INTEGRATED FLATTENING, CUTTING, AND COLLECTING ASSEMBLY CAPABLE OF INTEGRITY MAINTENANCE

FIELD OF THE INVENTION

The present invention relates generally to the field of the equipment integrity maintenance, and especially relates to an integrated flattening, cutting and collecting assembly capable of integrity maintenance.

BACKGROUND OF THE INVENTION

Steel sheet is a kind of commonly used raw material for machining. In some applications, steel sheet needs to be cut, mostly mechanically cut. Most of the existing sheet cutting machines are relatively simple, a lifting cylinder is used to control the cutter to cut steel sheets apart. Due to the flatness difference of steel sheets, the cutting position can be inaccurate, resulting in low cutting accuracy. Moreover, during cutting, steel sheets may move to a certain extent, which affects accuracy of the cutting again, and the qualified product needs machining after cutting.

OVERALL OBJECTIVERY OF THE INVENTION

The overall objective of the present invention is to provide an integrated flattening, cutting and collecting assembly capable of integrity maintenance, a steel sheet flattening part is provided before cutting, and together with the cutting lifting seat, a cutting pressing block is provided to press and hold the steel sheets in position during cutting, while not affecting steel sheet cutting, which improves greatly the cutting accuracy of steel sheets.

SUMMARY OF THE INVENTION

In order to achieve the above objective, the technical solutions adopted by the present invention are as follows: an integrated flattening, cutting and collecting assembly capable of integrity maintenance includes a frame, the frame is provided with a conveyor seat for conveying steel sheets, on the conveyor seat is provided a processing rack, wherein the processing rack is provided with a flattening cylinder and cutting cylinders in sequence, a flattening block matching the steel sheet in the conveyor seat is connected below the flattening cylinder, a cutting lift seat is provided below the cutting cylinder, the cutting lift seat is provided with a cutter and cutting pressing blocks, the cutting pressing blocks are arranged symmetrically on the left and right sides of the cutter, and the distance between the two cutting pressing blocks is smaller than the length of the flattening block, the lower end of the cutter exceeds the cutting pressing block, and the distance that it exceeds is the same as the thickness of the steel sheet, the end of the conveyor seat is provided with a collecting device.

Further, the collecting device includes a qualified product collecting box and a defective product collecting box provided on the left side of the qualified product collecting box, the left side plate and the right side plate of the qualified product collecting box and the left side plate of the defective product collecting box are flush with the conveyor seat, and the other side plates are higher than the conveyor seat; to the outer side of the front and rear sides of the qualified product collecting box are provided with horizontally movable supporting block feed cylinders, the supporting block feed cylinders are connected with supporting block feed blocks, and the supporting block feed blocks are connected with collecting supporting blocks that can be inserted into the qualified product collecting box, the height of the collecting supporting blocks are flush with the conveyor seat, in the front and rear walls of the qualified product collecting box where the collecting supporting block are fitted are provided with several supporting block limit balls, the upper part of the qualified product collecting box is provided with a collecting inspection cylinder, a collecting detecting lift block is connected below the collecting inspection cylinder, several fourth contact sensor are provided in a matrix below the collecting detecting lift block.

Further, the bottom of the qualified product collecting box is provided with collecting and receiving springs, the collecting and receiving springs are provided with a collecting and receiving block, the inner lower part of the qualified product collecting box is also provided with a spring protection block penetrated by the collecting and receiving springs.

Further, on the front and rear side plates of the processing rack are provided cutter inspection slots, and to the outside of the front and rear side plates of the processing rack are provided with inspection feeding cylinders movable back and forth; the inspection feeding cylinders are connected with inspection feeding blocks, the inspection feeding blocks are connected with inspection slot blocks which can pass the cutter inspection slot; the inner end of the inspection slot block is a slotted block concave in the middle, the slots thereof correspond to the position of the two cutting pressing blocks, where first contact sensors are embedded, the depth of the slots in the detecting slots coincides with the height difference between the cutter and the cutting pressing blocks.

Further, a pressure sensor is disposed at where the slot in the inspection slot block matches with the cutter, and a second contact sensor whose width is consistent with the cutter tip width is disposed under the pressure sensor located directly below the cutter.

Further, the cutting lift seat is provided with a cutter mounting block, the cutter is installed under the cutter mounting block, and the cutter cooperates with the cutting lift seat by gap plugging and fitting, the cutting lift seat at the left and right side of the cutter mounting block is provided with a cutter adjusting motor and a screw mounting block, a cutter adjusting screw is disposed between the cutter adjusting motor and the screw mounting block, and the cutter mounting block is sleeved on the cutter adjusting screw.

BENEFICIAL EFFECTS OF THE PRESENT INVENTION

The steel sheet flattened part is placed in front of the cutting part, meanwhile, the cutting lift block is provided with a cutting pressing block fitting the position of the cutter, the cutting pressing block is pressing and limiting the steel sheet during cutting, meanwhile, the cutting of the cutter is not affected, thereby the accuracy of the steel sheet cutting is greatly improved.

The structure of the collecting device is ingeniously designed, and it can measure the flatness of the cut products and then collect separately, which can reduce the process of sorting afterwards.

The structure of the collecting and receiving spring and the collecting and receiving block can prevent the steel sheets from bending due to a large drop during the falling process, the design of the spring protection block can ensure that the springs are not crushed.

The design of the inspection slot block and the inspection feeding cylinder can measure the height difference between the cutter in good condition and the cutting pressing block, thereby ensures smooth proceeding of the subsequent cutting.

The structure of the pressure sensor can ensure the cutter is in proper height and not excessively adjusted, the design of the second contact sensor can detect the slight offset of the cutter, which will ensure accurate cutting.

The structure of the cutter adjusting motor and the cutter adjusting screw can adjust the left and right position of the cutter, and then cooperate with the second contact sensor for the health maintenance of the position of the cutter.

REFERENCE NUMBER KEY

Figure 1:
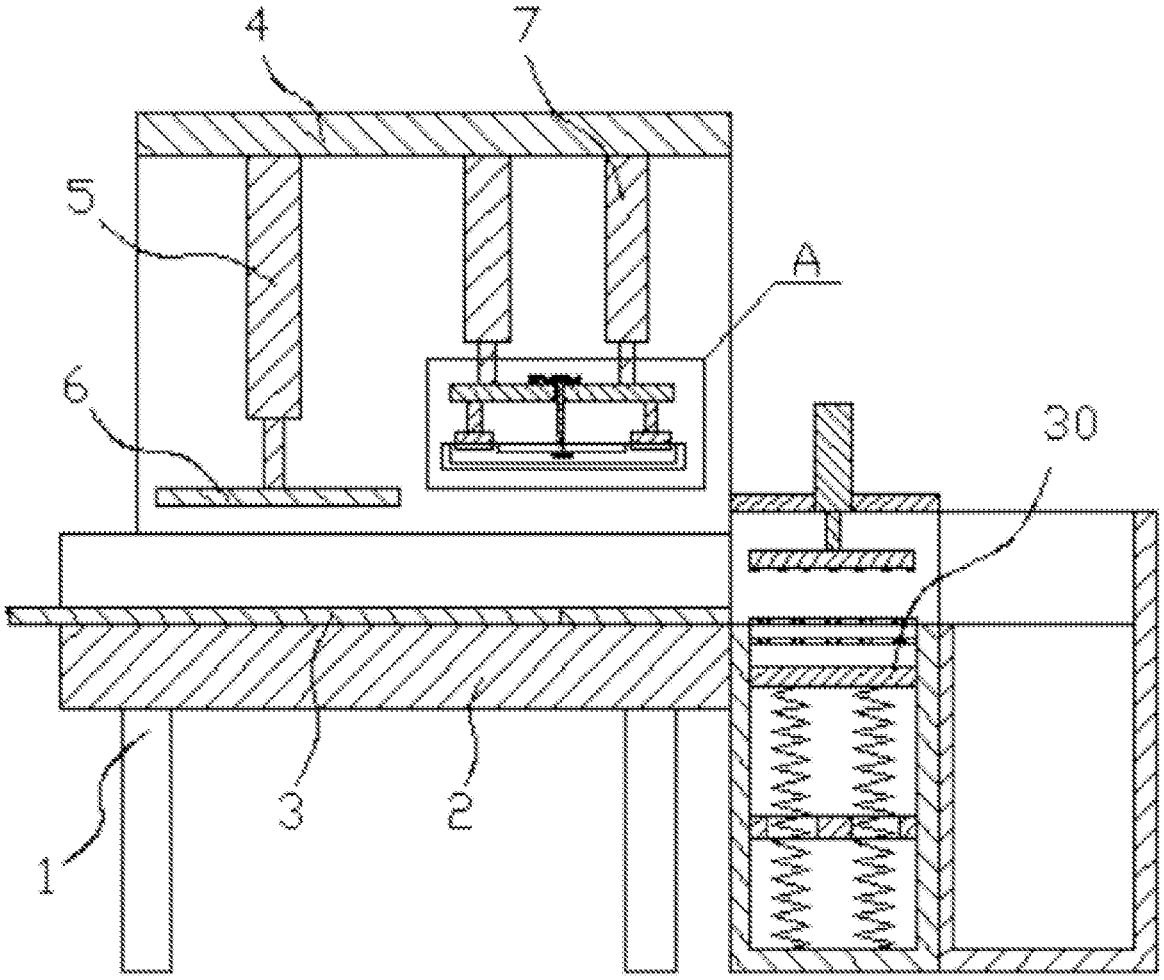
FIG. 1 is the structural schematic view of the integrated flattening, cutting and collecting assembly capable of integrity maintenance.

The drawings include following reference characters:

1—Frame;
2—Conveyor seat;
3—Steel sheet;
4—Processing rack;
5—Flattening cylinder;
6—Flattening block;
7—Cutting cylinder;
8—Cutting lift seat;
9—Cutting pressing block;
10—Cutter;
11—Cutter inspection slot;
12—Inspection feeding cylinder;
13—Inspection feeding block;
14—Inspection slot block;
15—First contact sensor;
16—Pressure sensor;
17—Second contact sensor;
20—Cutter adjusting motor;
21—Cutter adjusting screw;
22—Screw mounting block;
23—Cutter mounting block;
30—Collecting device;
31—Qualified product collecting box;
32—Collecting and receiving spring;
33—Collecting and receiving block;
34—Spring protecting block;
35—Collecting inspection cylinder;
36—Collecting inspection block;
37—Fourth contact sensor;
38—Supporting block limit ball
39—Collecting supporting block;
40—Supporting block feed block;
41—Supporting block feed cylinder;
42—Defective product collecting box.

DETAILED DESCRIPTION OF THE ILLUSTRATED EMBODIMENT

In order to enable those skilled in the art to better understand the technical solutions of the present invention, the present invention will be described in detail below with reference to the accompanying drawings. The description of the present section is merely exemplary and explanatory, and should not be construed as limiting the scope of the invention.

Figure 2:
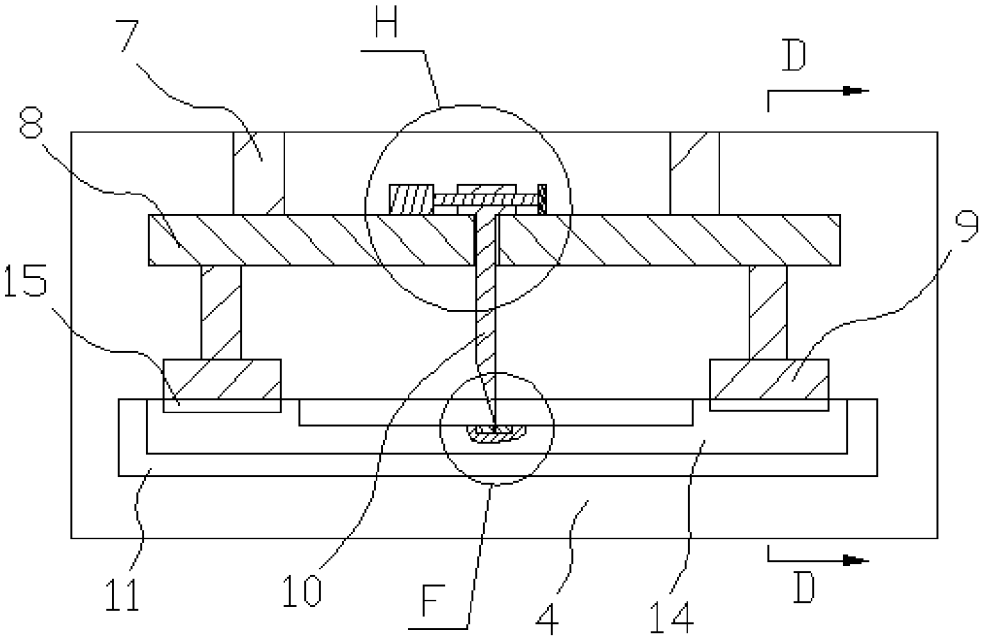
FIG. 2 is a partial enlarged view of part A in FIG. 1.
Figure 3:
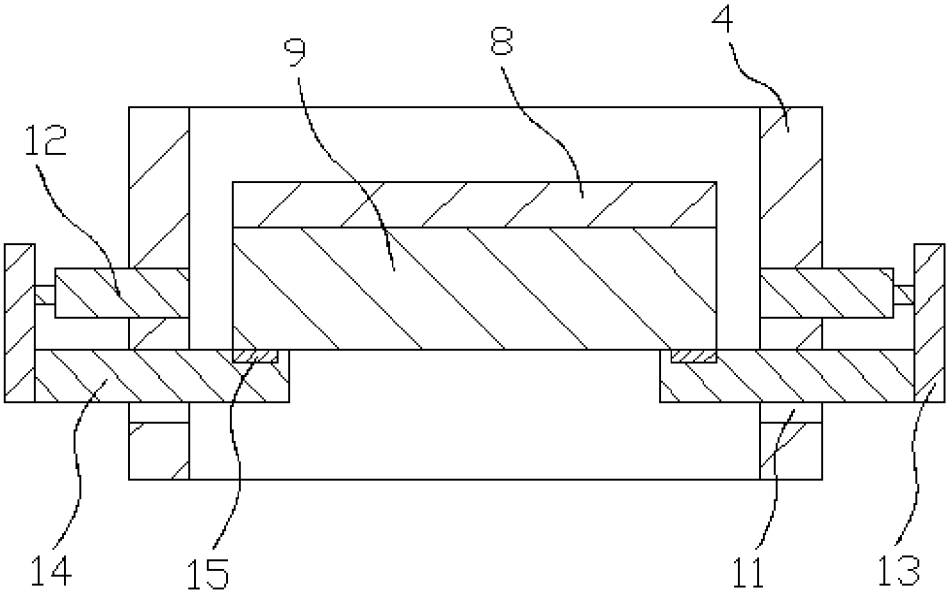
FIG. 3 is a cross-sectional view taken along line D-D of FIG. 2.
Figure 4:
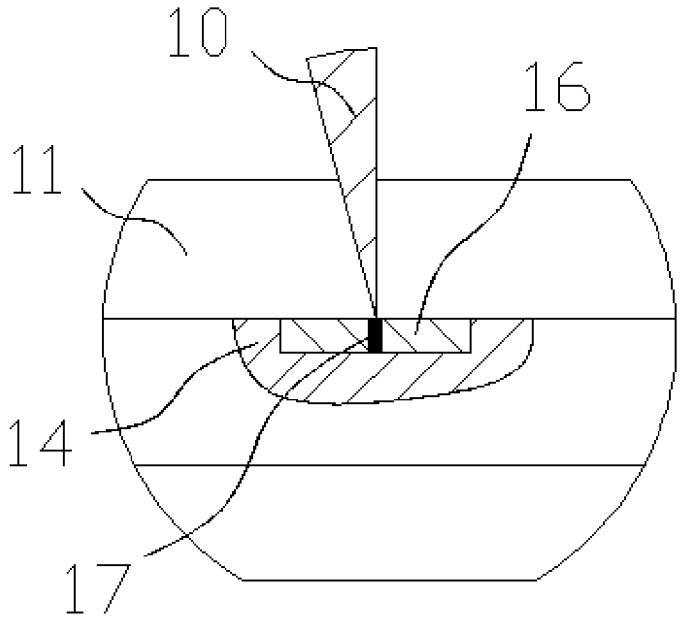
FIG. 4 is a partial enlarged view of part F in FIG. 2.
Figure 5:
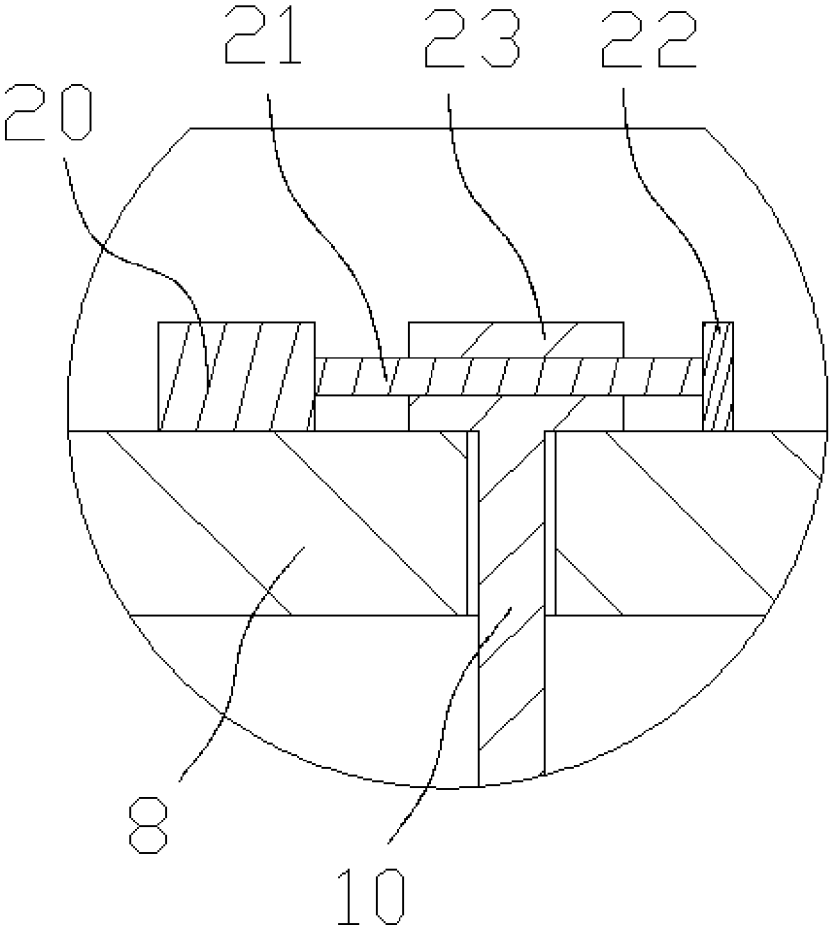
FIG. 5 is a partial enlarged view of part H in FIG. 2.
Figure 6:
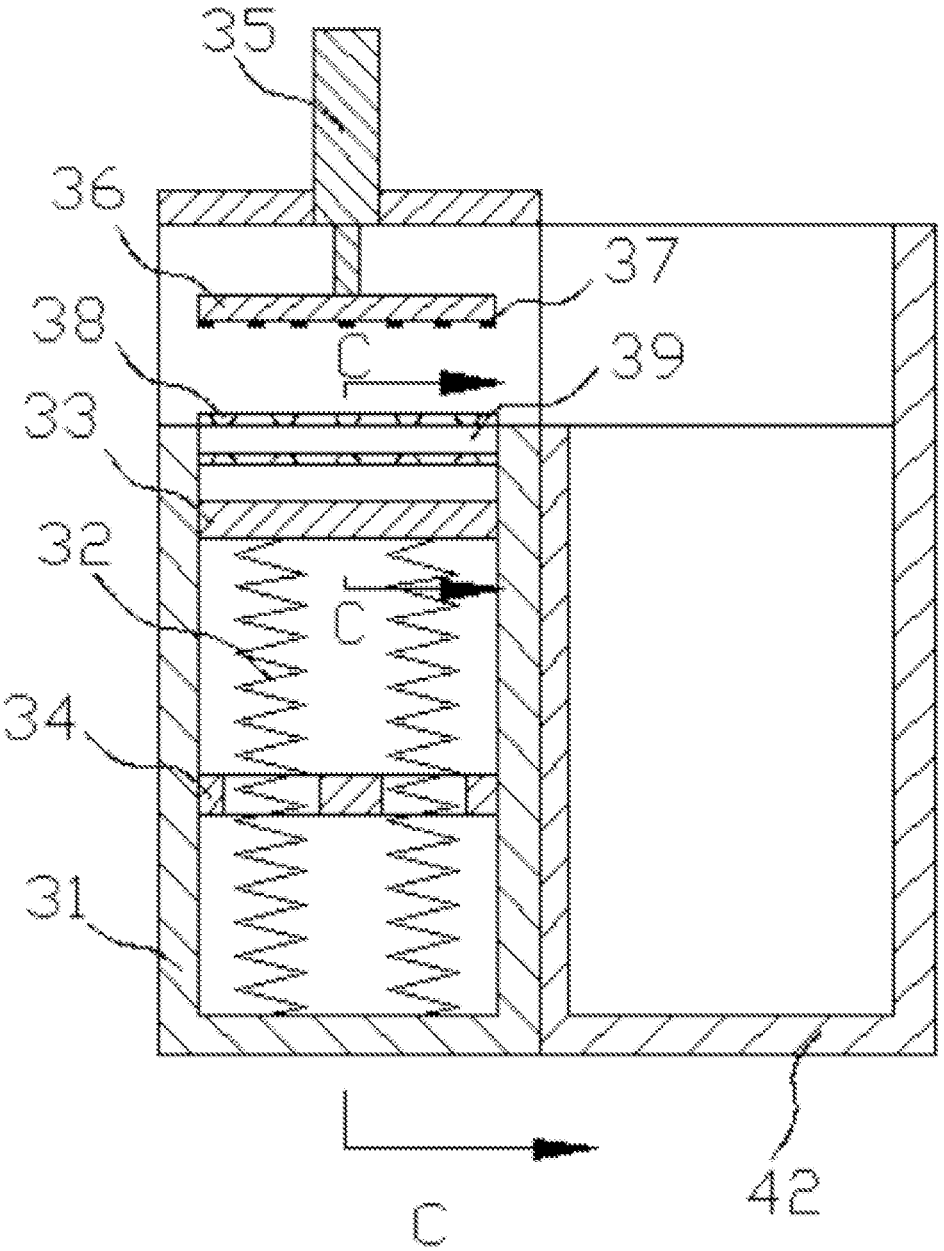
FIG. 6 is the structural schematic view of the collecting device.
Figure 7:
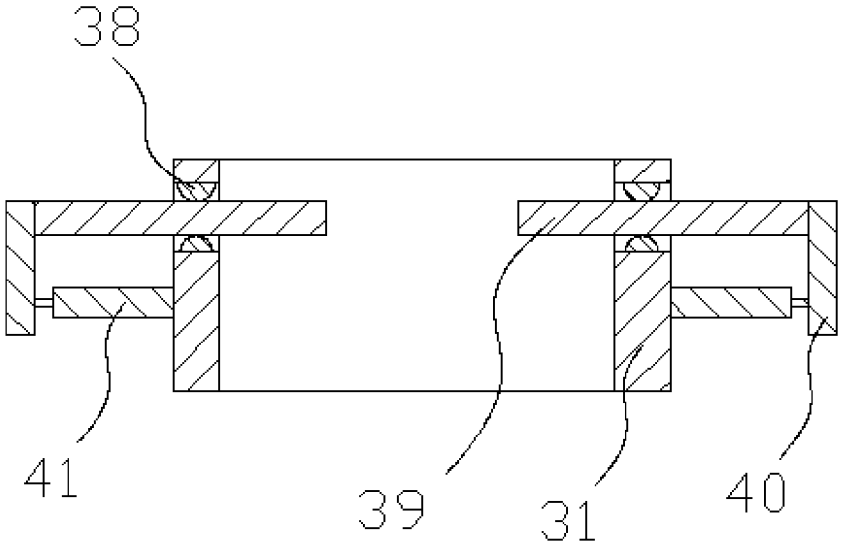
FIG. 7 is a cross-sectional view taken along line C-C of FIG. 6.

As shown in FIGS. 1 to 7, the specific structure of the present invention comprises:

An integrated flattening, cutting and collecting assembly capable of integrity maintenance includes a frame 1, the frame 1 is provided with a conveyor seat 2 for conveying steel sheets 3, on the conveyor seat 2 is provided a processing rack 4, wherein the processing rack 4 is provided with a flattening cylinder 5 and cutting cylinders 7 in sequence, a flattening block 6 matching the steel sheet 3 in the conveyor seat 2 is connected below the flattening cylinder 5, a cutting lift seat 8 is provided below the cutting cylinder 7, the cutting lift seat 8 is provided with a cutter 10 and cutting pressing blocks 9, the cutting pressing blocks 9 are arranged symmetrically on the left and right sides of the cutter 10, and the distance between the two cutting pressing blocks 9 is smaller than the length of the flattening block 6, the lower end of the cutter 10 exceeds the cutting pressing block 9, and the distance that it exceeds is the same as the thickness of the steel sheet 3, the end of the conveyor seat 2 is provided with a collecting device 3.

Preferably, the collecting device 30 includes a qualified product collecting box 31 and a defective product collecting box 32 provided on the left side of the qualified product collecting box 31, the left side plate and the right side plate of the qualified product collecting box 31 and the left side plate of the defective product collecting box 42 are flush with the conveyor seat 2, and the other side plates are higher than the conveyor seat 2; to the outer side of the front and rear sides of the qualified product collecting box 31 are provided with horizontally movable supporting block feed cylinders 41, the supporting block feed cylinders 41 are connected with supporting block feed blocks 40, and the supporting block feed blocks 40 are connected with collecting supporting blocks 39 that can be inserted into the qualified product collecting box 31, the height of the collecting supporting blocks 39 are flush with the conveyor seat 2, in the front and rear walls of the qualified product collecting box 31 where the collecting supporting block 39 are fitted are provided with several supporting block limit balls 38, the upper part of the qualified product collecting box 31 is provided with a collecting inspection cylinder 35, a collecting detecting lift block 36 is connected below the collecting inspection cylinder 35, several fourth contact sensor 37 are provided in a matrix below the collecting detecting lift block 36.

Preferably, the bottom of the qualified product collecting box 31 is provided with collecting and receiving springs 32, the collecting and receiving springs 32 are provided with a collecting and receiving block 33, the inner lower part of the qualified product collecting box 31 is also provided with a spring protection block 34 penetrated by the collecting and receiving springs 32.

Preferably, on the front and rear side plates of the processing rack 4 are provided cutter inspection slots 11, and to the outside of the front and rear side plates of the processing rack 4 are provided with inspection feeding cylinders 12 movable back and forth; the inspection feeding cylinders 12 are connected with inspection feeding blocks 13, the inspection feeding blocks 13 are connected with inspection slot blocks 14 which can pass the cutter inspection slot 11; the inner end of the inspection slot block 14 is a slotted block concave in the middle, the slots thereof correspond to the position of the two cutting pressing blocks 9, where first contact sensors 15 are embedded, the depth of the slots in the detecting slots 14 coincides with the height difference between the cutter 1 and the cutting pressing blocks 9.

Preferably, a pressure sensor 16 is disposed at where the slot in the inspection slot block 14 matches with the cutter 10, and a second contact sensor 17 whose width is consistent with the cutter 10 tip width is disposed under the pressure sensor 16 located directly below the cutter 10.

Preferably, the cutting lift seat 8 is provided with a cutter mounting block 23, the cutter 10 is installed under the cutter mounting block 23, and the cutter 10 cooperates with the cutting lift seat 8 by gap plugging and fitting, the cutting lift seat 8 at the left and right side of the cutter mounting block 23 is provided with a cutter adjusting motor 20 and a screw mounting block 22, a cutter adjusting screw 21 is disposed between the cutter adjusting motor 20 and the screw mounting block 22, and the cutter mounting block 23 is sleeved on the cutter adjusting screw 21. During use, first debug the device, and then put steel sheet 3 into the conveyor seat 2 and convey to the right. When the steel sheet 3 is under the flattening block 6, the flattening block 6 is pressed under the action of the flattening cylinder 5, and the corresponding steel sheet 3 is flattened. After that, the steel sheet is continuously conveyed, and when the steel sheet is conveyed under the cutter 10, the cutting lift seat 8 descends under the effect of the cutting cylinder 7, thereby the steel sheet is pressed in position by the cutting pressing block 9; meanwhile, and cutting of the steel sheet is finished by the cutter 10.

Then subsequent steel sheets are conveyed continuously and the above flattening and cutting process is repeated. The cut steel sheet is pushed into the qualified product collecting box 31 and supported by the collecting supporting block 39. Then, the collecting inspection cylinder 35 drives the collecting detecting lift block 36 to descend. The flatness of steel sheet can be determined by checking whether all fourth contact sensors 37 generate sensing signal. If all the fourth contact sensors 37 generate sensing signal, the steel sheet is proved to be qualified product. The supporting block feed cylinder 41 drives the collecting supporting block 39 to move outwards, thereby the steel sheet falls onto the collecting block 33, the collecting and receiving springs 32 are pressed down a little so that the upper surface of the steel sheet remains aligned with the upper surface of the original collecting block 33 (this can be achieved by setting the stiffness coefficient of the springs according to the weight of the steel sheet). If not all of the fourth contact sensors generate the sensing signal at the same time, the steel sheet is proved to be a defective product, and the next steel sheet will push it into the defective collecting box 42.

When the cutter 10 is used for a while, drive the inspection slot block 14 to insert into the processing rack 4 with the inspection feeding cylinder 12, and drive the cutting lift block 8 to descend with the cutting cylinder 7. Stop the decline of the cutting cylinder 7 when the cutting pressing block 9 contacts the first contact sensor 15. If the pressure sensor 16 does not generate a pressure signal, it proves that the cutter is worn; if the pressure sensor 16 generates a pressure signal, check whether the cutter 10 is deviated by checking whether the second contact sensors 17 generate an sensing signal, if no sensing signal is generated, drive the cutter adjusting screw 21 to move with the cutter adjusting motor 20, thereby drive the cutting mounting block 23 to move until the second contact sensor 17 generates signal, so that the position adjustment of the grinded cutter is finished, after that, return the inspection feeding cylinder to the original position and continue cutting operation.

It is to be understood that the terms "includes", "including" or any other variants thereof are intended to encompass a non-exclusive inclusion, such that a process, method, article, or device comprising a plurality of elements includes not only those elements, but also includes other elements that are not explicitly listed, or elements that are inherent to such a process, method, item, or device.

The principles and embodiments of the present invention have been described herein with reference to specific examples, and the description of the above examples is only to assist in understanding the method of the present invention and its core idea. The above description is only a preferred embodiment of the present invention, and it should be noted that due to the finiteness of the textual expression, there is an infinitely specific structure objectively, It will be apparent to those skilled in the art that a number of improvements, modifications, or variations may be made without departing from the principles of the invention, and the technical features described above may be combined in a suitable manner; These improvements, modifications, or combinations, or the direct application of the inventive concepts and technical solutions to other applications without modifications, are considered to be within the scope of the present invention.

What is claimed is:

1. An integrated flattening, cutting and collecting assembly capable of integrity maintenance, comprises:

a frame provided with a conveyor seat having an upper planar surface for conveying steel sheets;

a processing rack is disposed above said conveyor seat, wherein said processing rack is provided with a flattening cylinder and cutting cylinders in a sequential manner as considered in the conveying direction of said conveyor seat;

a flattening block, having a predetermined length dimension, is mounted upon a lower end portion of said flattening cylinder and is disposed in a plane parallel to said steel sheets being conveyed by said conveyor seat;

a cutting lift seat is mounted upon lower end portions of said cutting cylinders, wherein said cutting lift seat is provided with a cutter and a pair of cutting pressing blocks which are disposed upon opposite sides of said cutter, wherein the distance defined between said pair of cutting pressing blocks is smaller than said predetermined length dimension of said flattening block, a lower end portion of said cutter is disposed beneath said pair of cutting pressing blocks, and the distance that said lower end portion of said cutter is disposed beneath said pair of cutting pressing blocks is equal to the thickness of said steel sheets being conveyed by said conveyor seat;

a downstream end portion of said conveyor seat is operatively associated with a collecting device for collecting cut portions of said steel sheets;

wherein said collecting device comprises a first product collecting box and a second product collecting box disposed toward one side of said first product collecting box, upper end portions of first plates of said first and second product collecting boxes being disposed within the same plane as said upper planar surface of said conveyor seat while second side plates of said first and second product collecting boxes extend above said upper planar surface of said conveyor seat (2);

a pair of horizontally oriented supporting block feed cylinder-piston assemblies are mounted upon external side wall portions of said first product connecting box, pistons of said pair of horizontally oriented supporting block feed cylinder-piston assemblies are connected to a pair of supporting block feed blocks, and said pair of supporting block feed blocks (40) are connected to first ends of a pair of collecting supporting blocks while second opposite ends of said pair of collecting supporting blocks extend through front and rear walls of said first product collecting box so as to be disposed internally within said first product collecting box, upper surface portions of said collecting supporting blocks being coplanar with said upper planar surface of said conveyor seat, a plurality of supporting block limit balls are provided within said front and rear walls of said first product collecting box for permitting slidable movement of said pair of collecting supporting blocks with respect to said front and rear walls of said first product collecting box; and a collecting inspection cylinder is mounted within an upper section of said first product collecting box, a collecting detecting lift block is dependently connected to said collecting inspection cylinder, and a plurality of contact sensors are disposed within a predetermined array upon a lower surface portion of said collecting detecting lift block.

2. The integrated flattening, cutting and collecting assembly as set forth in claim 1, wherein:

a bottom section of said first product collecting box is provided with a plurality of collecting and receiving springs, wherein lower end portions of said plurality of collecting and receiving springs are engaged with a floor portion of said first product collecting box while upper end portions of said plurality of collecting and receiving springs are engaged with a collecting and receiving block and intermediate portions of said plurality of collecting and receiving springs pass through a spring protection block disposed within said first product collecting box.

3. The integrated flattening, cutting and collecting assembly as set forth in claim 1, wherein:

a pair of cutter inspection slots are respectively defined within front and rear side plates of said processing rack, a pair of inspection feeding cylinders are mounted upon said front and rear plates of said processing rack for front to back reciprocating movements;

said pair of inspection feeding cylinders are operatively connected to a pair of inspection feeding blocks;

said pair of inspection feeding blocks are operatively connected to a pair of inspection slot blocks which pass through said pair of cutter inspection slots;

opposite inner end portions of said inspection slot blocks are are provided with cut-out regions, having a predetermined depth, disposed beneath said pair of cutting pressing blocks; and wherein a pair of contact sensors are embedded within said cut-out regions of said opposite inner end portions of said inspection slot blocks, said predetermined depth of said cut-out regions of said inspection slot blocks coinciding with the distance that said lower end portion of said cutter is disposed beneath said pair of cutting pressing blocks.

4. The integrated flattening, cutting and collecting assembly claim 3, wherein:

a pressure sensor is embedded within said inspection slot block; and a second contact sensor is embedded within said pressure sensor so as to be located directly beneath a tip portion of said cutter.

5. The integrated flattening, cutting and collecting assembly as set forth in claim 1, wherein:

said cutting lift seat is provided with a cutter mounting block;

said cutter is mounted upon said cutter mounting block;

a cutter adjusting motor is mounted upon said cutting lift seat;

a screw mounting block is mounted upon said cutting lift seat so as to be disposed opposite said cutter adjusting motor;

a cutter adjusting screw has opposite ends thereof operatively connected to said cutter adjusting motor and said screw mounting block such that said cutter adjusting screw is threadingly engaged internally with said cutter mounting block such that as said cutter adjusting screw is rotated by said cutter adjusting motor, said cutter mounting block will be moved so as to in turn move said cutter.

* * * * *